US007588430B2

(12) United States Patent
Hasegawa

(10) Patent No.: US 7,588,430 B2
(45) Date of Patent: Sep. 15, 2009

(54) SCREW COMPRESSOR

(75) Inventor: Masataka Hasegawa, Takasago (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 278 days.

(21) Appl. No.: 11/174,661

(22) Filed: Jul. 6, 2005

(65) Prior Publication Data

US 2006/0008375 A1 Jan. 12, 2006

(30) Foreign Application Priority Data

Jul. 12, 2004 (JP) ..... 2004-204696

(51) Int. Cl.
*F01C 1/16* (2006.01)

(52) U.S. Cl. ..... 418/201.1; 418/201.2; 418/202

(58) Field of Classification Search ..... None
See application file for complete search history.

(56) References Cited

U.S. PATENT DOCUMENTS 3,936,239 A * 2/1976 Shaw ..... 417/315
4,678,406 A * 7/1987 Pillis et al. ..... 417/310
4,704,069 A * 11/1987 Kocher et al. ..... 417/53
5,018,948 A * 5/1991 Sjte et al. ..... 417/302
5,509,273 A * 4/1996 Lakowske et al. ..... 62/228.5
5,979,168 A * 11/1999 Beekman ..... 62/228.8
6,082,985 A * 7/2000 Suzuki et al. ..... 418/201.2

FOREIGN PATENT DOCUMENTS

| | | |
|---|---|---|
| JP | 53-117174 | 10/1978 |
| JP | 62-78497 | 4/1987 |
| JP | 05-052439 | 8/1993 |
| JP | 7-103165 | 4/1995 |
| JP | 11-82341 | 3/1999 |

* cited by examiner

*Primary Examiner*—Thomas Denion
*Assistant Examiner*—Douglas J. Duff
(74) *Attorney, Agent, or Firm*—Oblon, Spivak, McClelland, Maier & Neustadt, P.C.

(57) ABSTRACT

A screw compressor according to the present invention includes a slide valve adapted to move forward and backward in parallel with the axis of a pair of screw rotors and also includes a plurality of hydraulic cylinders for moving the slide valve forward and backward, the plural hydraulic cylinders imparting, in synchronization with each other, a driving force to the slide valve in the same direction. With this configuration, it is possible to quicken an operation of the slide valve and improve the responsivity in volume control without increasing the diameters of pistons of the hydraulic cylinders for actuating the slide valve and without complicating equipment.

5 Claims, 2 Drawing Sheets

SCREW COMPRESSOR

BACKGROUND OF THE INVENTION

1. Field of the Invention

The present invention relates to a screw compressor having a slide valve for adjusting a volume of discharged gas.

2. Description of the Related Art

A screw compressor having a slide valve to adjust the volume of discharged gas has heretofore been known publicly.

It is preferable for the slide valve to be superior in its operation responsivity so that the screw compressor can discharge compressed gas without excess or deficiency in the amount of the gas required in accordance with a change in the amount of consumption of the compressed gas discharged. However, in case of the slide valve being actuated by an ordinary type of a hydraulic cylinder and in case of the hydraulic cylinder being a single hydraulic cylinder, the operation of the slide valve becomes slow and the responsivity in operation, i.e., the responsivity in volume control, of the slide valve is poor.

For improving the responsivity it is necessary to increase the power for actuating the slide valve. The power may be increased by enlarging the diameter of a piston in the hydraulic cylinder or by using pressurizing means for increasing the oil pressure. However, in view of the structure of the screw compressor, a limit is in many cases encountered in increasing the diameter of the piston. Further, the addition of pressurizing means for increasing the oil pressure leads to a more complicated configuration of equipment concerned.

SUMMARY OF THE INVENTION

It is an object of the present invention to eliminate the above-mentioned conventional problems related to responsivity of a slide valve.

First, a screw compressor according to the present invention comprises a pair of screw rotors, a slide valve disposed in parallel with the axis of the screw rotor, and a plurality of hydraulic cylinders for moving the slide valve forward and backward, the plural hydraulic cylinders imparting, in synchronization with each other, a driving force to the slide valve in the same direction. Preferably, the plural hydraulic cylinders comprise a first hydraulic cylinder disposed on a suction side of the slide valve and a second hydraulic cylinder disposed on a discharge side of the slide valve. It is also preferable that the plural hydraulic cylinders comprise a first hydraulic cylinder disposed on a suction side of the slide valve and a second hydraulic cylinder connected in series with the first hydraulic cylinder.

In the screw compressor according to the present invention, the slide valve can be operated quickly and its responsivity in volume control can be improved without increasing the diameter of a piston in each hydraulic cylinder or without complicating the equipment concerned.

DETAILED DESCRIPTION OF THE PREFERRED EMBODIMENTS

Figure 1:
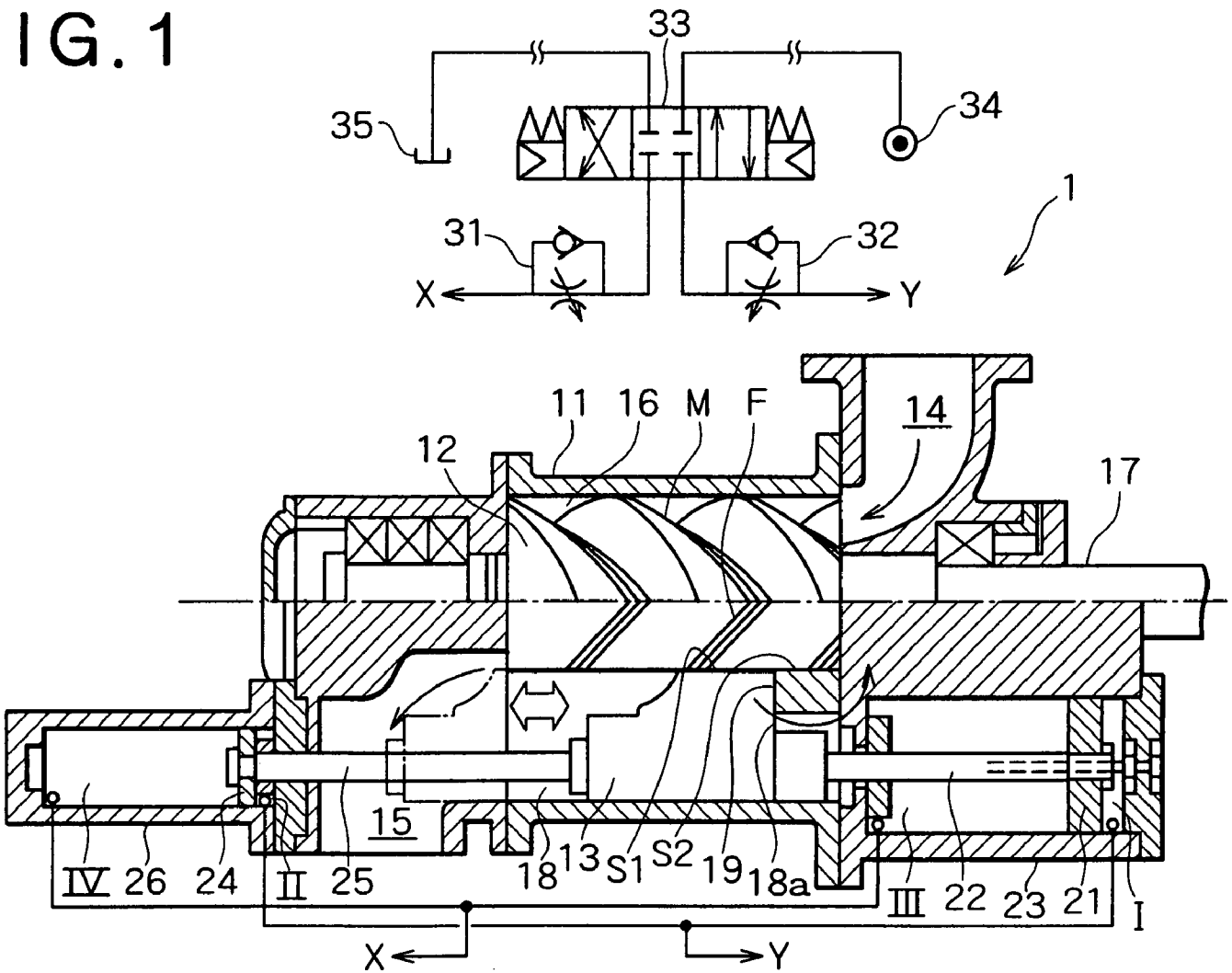
FIG. 1 is a diagram schematically showing an entire configuration of a screw compressor according to the present invention.

Embodiments of the present invention will be described in detail hereinunder with reference to the accompanying drawings. FIG. 1 shows a screw compressor 1 according to an embodiment of the present invention.

The screw compressor 1 includes a pair of female and male screw rotors 12, i.e., a female rotor F and a male rotor M, accommodated rotatably within a casing 11 and meshing with each other. The screw compressor 1 further includes a slide valve 13 in parallel with the axes of the screw rotors 12. The slide valve 13 is accommodated in the interior of the casing 11 in such a manner that the axis of the slide valve 13 is parallel to the axes of the screw rotors 12. With such a configuration, the slide valve 13 can move forward and backward in directions parallel to the axes of the screw rotors 12.

A suction port 14 is formed on one side of the casing 11, a discharge port 15 is formed on the other side of the casing 11, and a rotor chamber 16 is formed between the suction port 14 and the discharge port 15. The screw rotors 12 are accommodated in the rotor chamber 16. A rotor shaft 17 projecting from the suction side of the male rotor M is rotated by a motor (not shown). Further, the screw rotors 12 are rotated by a motor (not shown) through the rotor shaft 17.

In FIG. 1, an upper portion with respect to a dot-dash line is a vertical cross section of the portion where the male rotor M is positioned, while a lower portion with respect to the dot-dash line is a vertical cross section of the portion where the female rotor F is positioned. In FIG. 1, the male rotor M and the female rotor F are depicted conceptually so that the difference between the two can be understood. In other words, the present invention is not limited at all to the illustrated shape. As to a rotor shaft and a bearing for supporting the female rotor F, their illustrations are omitted because they are not related to the essence of the present invention.

A valve operating space 18 which is opened to the rotor chamber 16 is formed in adjacency to the rotor chamber 16. The slide valve 13 is accommodated within the valve operating space 18. A surface S1 of the slide valve 13 which surface is opposed in proximity to the screw rotors 12 extends to both sides of an intermeshing portion of both female rotor F and male rotor M and is formed in a shape constituting a part of a wall surface of the rotor chamber 16. Likewise, a surface S2 which is opposed in proximity to the screw rotors 12 extends to both sides of the intermeshing portion of both female rotor F and male rotor M. A stopper 19 formed in a shape constituting a part of the wall surface of the rotor chamber 16 is provided projectingly on the suction side of the valve operating space 18. Though not shown, the suction port 14 actually extends to a lower portion of the rotor shaft 17 and a space portion 18*a* formed on the suction side of the valve operating space 18 is open to the lower extended portion of the suction port 14 without going through the rotor chamber 16.

A piston 21 and a piston rod 22 are provided on the suction side of the slide valve 13. A first hydraulic cylinder 23 adapted to extend and contract in parallel with the axes of the screw rotors 12 is provided. A piston 24 and a piston rod 25 are provided on the discharge side of the slide valve 13. A second hydraulic cylinder 26 adapted to extend and contract in parallel with the axes of the screw rotors 12 is provided. The piston rod 22 is connected to an end on the suction side of the slide valve 13, while the piston rod 25 is connected to an end on the discharge side of the slide valve 13.

On the other hand, the first hydraulic cylinder 23 and the second hydraulic cylinder 26 are connected to an oil pressure source 34 and an oil tank 35 by piping through flow control valves 31 and 32 with check valves and further through a four-port three-way selector valve 33. That is, a hydraulic circuit is configured by the first and second hydraulic cylinders 23, 26, flow control valve 31 with check valve, flow control valve 32 with check valve, four-port three-way selector valve 33, oil pressure source 34, oil tank 35, and pipes for connection of those components. In FIG. 1, a part of the piping is not shown in order to make the drawing more clear. Actually, X-marked portions are in communication with each other and so are the Y-marked portions.

As shown in FIG. 1, an intra-cylinder space I formed on the right side of the piston 21 and an intra-cylinder space II formed on the right side of the piston 24, on which an oil pressure acts when the slide valve 13 operates to the discharge side, i.e., leftward in FIG. 1, are in communication with each other by piping. Likewise, an intra-cylinder space III formed on the left side of the piston 21 and an intra-cylinder space IV formed on the left side of the piston 24, on which an oil pressure acts when the slide valve 13 operates to the suction side, i.e., rightward in FIG. 1, are in communication with each other by piping. That is, for the first and second hydraulic cylinders 23, 26, in order to impart a driving force to the slide valve 13 in the same direction and in synchronization with each other, the intra-cylinder spaces positioned in the same direction are in communication with each other. In this way the piston rod 22 of the first hydraulic cylinder 23 and the piston rod 25 of the second hydraulic cylinder 26 are operated in the same direction in synchronization with each other.

When the slide valve 13 lies in its position indicated by a solid line in FIG. 1, that is, when the slide valve 13 is in abutment against the stopper 19, there is no gap between the slide valve 13 and the stopper 19 and the screw compressor 1 is in a state of loaded operation (full load operation). In this state, the total amount of gas sucked from the suction port 14 into the screw rotors 12 is compressed and discharged from the discharge port 15. The gas discharged amount of compressed in this state becomes maximum. Insofar as the four-port three-way selector valve 33 is in its state shown in FIG. 1, the state of this load operation is maintained.

When a flow path is changed by the four-port three-way selector valve 33, the oil pressure source 34 comes into communication with the intra-cylinder spaces I and II and the oil tank 35 comes into communication with the intra-cylinder spaces III and IV, whereupon the piston 21 and piston rod 22 of the first hydraulic cylinder 23 and the piston 24 and piston rod 25 of the second hydraulic cylinder 26 operate in synchronization with each other and the slide valve 13 moves to the discharge side, i.e., leftward. As a result, a gap is formed between the slide valve 13 and the stopper 19, the screw compressor 1 shifts to a state of unloaded operation (partial loaded operation or minimum loaded operation), and the volume of discharged gas is adjusted. In the partial loaded operation, a part of gas which has been sucked from the suction port 14 into the screw rotors 12 returns from the gap between the slide valve 13 and the stopper 19 to the suction port 14 through the space potion 18*a* formed on the suction side of the valve operating space 18. The remaining part except the aforesaid part of the sucked gas is compressed and discharged from the discharge port 15. When the slide valve 13 lies in its position indicated by a dash-double dot line in FIG. 1, the screw compressor 1 assumes a state of minimum loaded operation which is an ultimate state of unloaded operation. At this time, most of the gas sucked from the suction port 14 into the screw rotors 12 returns from the gap between the slide valve 13 and the stopper 19 to the suction port 14 through the space portion 18*a* formed on the suction side of the valve operating space 18. The minimum loaded operation may be also called merely no-load operation because it is close to a no-load condition.

Thereafter, the flow path is changed by the four-port three-way selector valve 33 for adjusting the volume of discharged gas and the oil pressure source 34 comes into communication with the intra-cylinder spaces III and IV, while the oil tank 35 comes into communication with the intra-cylinder spaces I and II. As a result, the piston 21 and piston rod 22 of the first hydraulic cylinder 23 and the piston 24 and the piston rod 25 of the second hydraulic cylinder 26 operate in synchronization with each other and the slide valve 13 moves to the suction side, i.e., rightward. Consequently, the gap between the slide valve 13 and the stopper 19 vanishes and the foregoing state of loaded operation is formed.

Thus, the screw compressor 1 is provided with the first and second hydraulic cylinders 23, 26 which are adapted to operate in synchronization with each other to impart a driving force in the same direction to the slide valve 13. Accordingly, there is no such structural problem as that occurring in case of using only a single hydraulic cylinder and increasing the diameter of its piston, nor is there any fear of complication of equipment caused by the addition of pressurizing means for increasing the oil pressure. Moreover, it is possible to strengthen the driving force for the slide valve 13 to quicken the operation of the same valve and improve the responsivity in volume control.

Further, in the screw compressor 1, since the slide valve 13 is positioned between the first and second hydraulic cylinders 23, 26 and is supported on both sides thereof, it is difficult to displace the slide valve 13 in a direction orthogonal to the axis of the first hydraulic cylinder 23 and hence in a direction orthogonal to the axis of the second hydraulic cylinder 26. Consequently, the slide valve 13 is prevented from coming into contact to an abnormal extent with the side wall which surrounds the slide valve 13 sideways or with the screw rotors 12.

Figure 2:
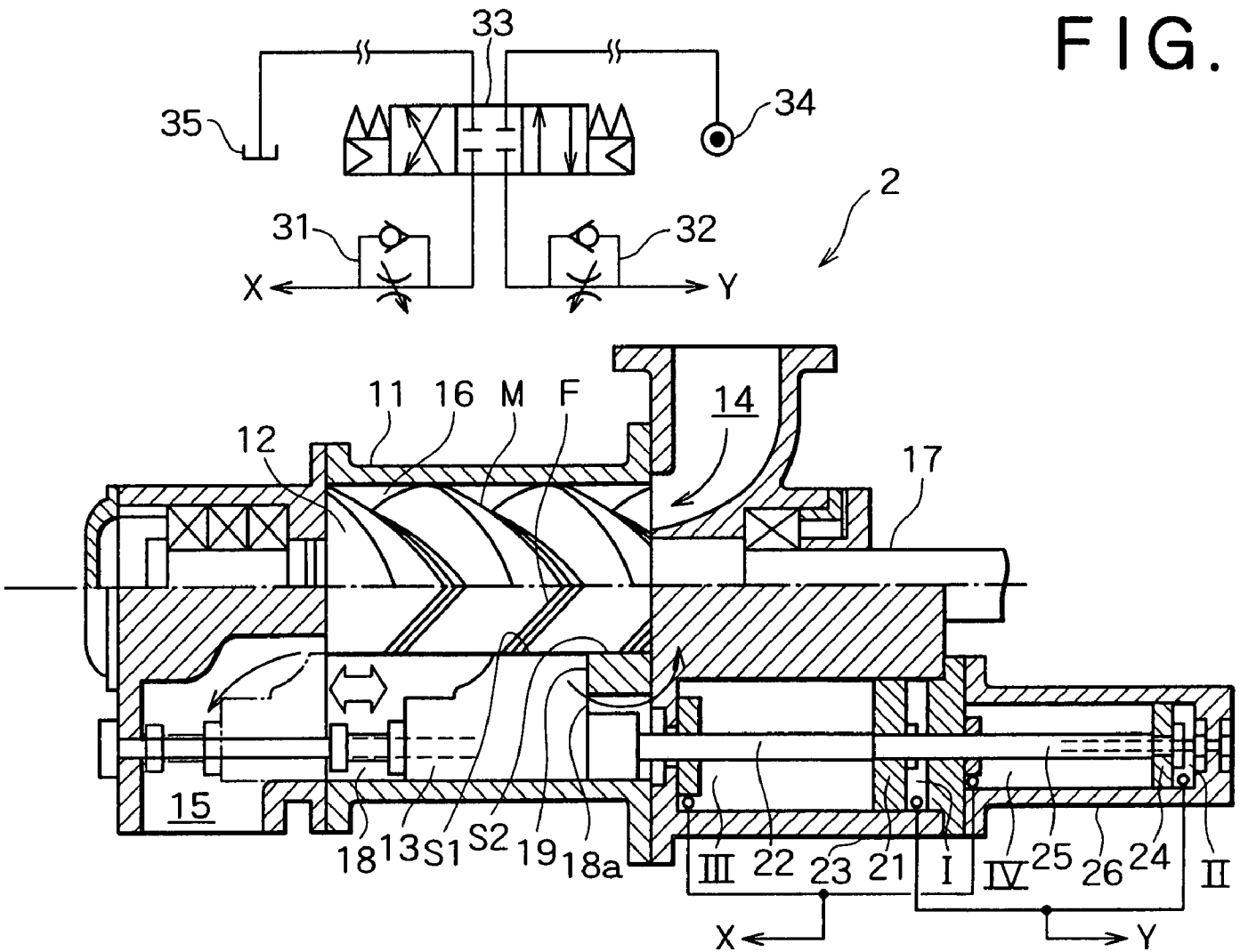
FIG. 2 is a diagram schematically showing an entire configuration of another screw compressor according to the present invention.

FIG. 2 shows a screw compressor 2 according to another embodiment of the present invention. In FIG. 2, portions common to the screw compressor 1 described above are identified by the same reference numerals as in FIG. 1 and explanations thereof will here be omitted. In the screw compressor 2, a second hydraulic cylinder 26 is connected in series with a bottom side, i.e., the right-hand side in FIG. 2, of a first hydraulic cylinder 23.

According to this configuration, like the above configuration, there is no fear for a problem that occurring in case of increasing a diameter of its piston or increasing oil pressure, and it is possible to strengthen the driving force for the slide valve 13 to quicken the operation of the same valve and improve the responsivity in volume control. Besides, since the first and second hydraulic cylinders 23, 26 are connected in series with each other, oil pressure pipes associated with both hydraulic cylinders are easily laid in a compact manner.

In the present invention the number of plural hydraulic cylinders for actuating the slide valve 13 is not limited to two. Regarding on which of suction side and discharge side each hydraulic cylinder is to be disposed, no limitation is made, either. Thus, it is not always necessary to dispose the first hydraulic cylinder 23 on the suction side of the slide valve 13.

What is claimed is:

1. A screw compressor comprising:

a pair of screw rotors rotatable in a chamber;

a slide valve, said slide valve being disposed in parallel with the axis of said screw rotor, wherein said slide valve is disposed at the chamber to confront the rotors and is mounted and configured to adjust the capacity of the compressor by adjusting the sectional area of the outlet of the chamber;

a plurality of hydraulic cylinders, said plural hydraulic cylinders having pistons moving said slide valve forward and backward; and means for imparting a drive force to said cylinders such that said pistons always move in synchronization with each other in the same direction.

2. The screw compressor according to claim 1, wherein said plural hydraulic cylinders comprise a first hydraulic cylinder disposed on a suction side of said slide valve and a second hydraulic cylinder disposed on a discharge side of said slide valve.

3. The screw compressor according to claim 1, wherein said plural hydraulic cylinders comprise a first hydraulic cylinder disposed on a suction side of said slide valve and a second hydraulic cylinder connected in series with said first hydraulic cylinder.

4. The screw compressor according to claim 1, wherein said means for imparting a drive force comprises hydraulic fluid lines connected such that internal spaces of said plural hydraulic cylinders are in fluid communication with each other.

5. The screw compressor according to claim 1, wherein said means for imparting a drive force comprises:

a hydraulic fluid line communicating with internal spaces of said plural hydraulic cylinders; and a valve which selectively fluidically communicates said hydraulic fluid line with one of a source of hydraulic fluid under pressure and a hydraulic fluid drain, such that the internal spaces of said plural hydraulic cylinders are selectively and synchronously fluidically communicated by said valve with one of the source of hydraulic fluid under pressure and the hydraulic fluid drain.

* * * * *